US009714137B2

(12) United States Patent
Hamilton et al.

(10) Patent No.: US 9,714,137 B2
(45) Date of Patent: Jul. 25, 2017

(54) THERMAL BOX AND TRANSPORT SYSTEM

(71) Applicant: Phoenix Services International, LLC, Kennett Square, PA (US)

(72) Inventors: Arthur I Hamilton, Maryville, IL (US); Charles Simpson, Independence, KY (US); Joel Kendrick, Spanish Fort, AL (US); Shannon James Crouse, Abingdon, MD (US)

(73) Assignee: Phoenix Services International, LLC, Kennett Square, PA (US)

( * ) Notice: Subject to any disclaimer, the term of this patent is extended or adjusted under 35 U.S.C. 154(b) by 81 days.

(21) Appl. No.: 14/628,755

(22) Filed: Feb. 23, 2015

(65) Prior Publication Data

US 2015/0375929 A1 Dec. 31, 2015

Related U.S. Application Data

(60) Provisional application No. 61/946,204, filed on Feb. 28, 2014.

(51) Int. Cl.
*B65D 88/12* (2006.01)
*B65D 90/00* (2006.01)

(52) U.S. Cl.
CPC ..... *B65D 88/129* (2013.01); *B65D 88/126* (2013.01); *B65D 90/0033* (2013.01)

(58) Field of Classification Search
CPC . B65D 88/129; B65D 90/0033; B65D 88/126
USPC ..... 220/4.21, 4.22, 4.23, 4.24, 4.06, 592.2, 220/592.01; 108/55.1, 55.11
See application file for complete search history.

(56) References Cited

U.S. PATENT DOCUMENTS 2,707,550 A * 5/1955 Coney ..... A45C 11/20 206/544
4,369,883 A * 1/1983 Stravitz ..... G11B 23/0236 206/387.15
4,682,811 A * 7/1987 Ooguro ..... B60J 5/0498 105/378
5,624,049 A * 4/1997 Kovash ..... B65D 88/121 220/1.5
6,283,321 B1 * 9/2001 Meshorer ..... B65F 1/06 220/4.22
6,890,020 B2 * 5/2005 Bush, Sr. ..... B62D 33/02 296/186.2

(Continued)

*Primary Examiner* — Robert J Hicks
*Assistant Examiner* — Kareen Thomas
(74) *Attorney, Agent, or Firm* — Baker & Hostetler LLP

(57) ABSTRACT

This disclosure relates to a system and method for insulating a mill product during a transporting and storing process. The system includes a platform, an insulated enclosure, and an actuator system. The platform is capable of supporting the insulated enclosure and the mill product. The insulated enclosure includes a first clamshell enclosure member and a second clamshell enclosure member supported on the platform. Each enclosure member has an open position and a closed position. When each enclosure member is in the open position, the mill product supported on the platform within the enclosure may be accessed. When each enclosure member is in the closed position, the mill product is thermally insulated within the enclosure. The actuator system can move the clamshell enclosures between their open and closed positions.

16 Claims, 5 Drawing Sheets

(56) References Cited

U.S. PATENT DOCUMENTS

2009/0242552 A1* 10/2009 Myers ..... B65D 88/121
220/4.33

* cited by examiner

THERMAL BOX AND TRANSPORT SYSTEM

CROSS-REFERENCE

This application claims the benefit under 35 U.S.C §119 (e) of Provisional U.S. Patent Application No. 61/946,204 filed on Feb. 28, 2014, and entitled "THERMAL BOX AND TRANSPORT SYSTEM," the content of which is incorporated by reference herein in its entirety.

TECHNICAL FIELD

This disclosure relates generally to insulated enclosures, and more particularly, to systems and methods for handling, insulating, and supporting hot metal slabs and related uses for the structure and methods.

BACKGROUND

In modern steelmaking practice, metal is solidified into a semi-finished product, such as a billet, bloom, coil, slab, or the like. The semi-finished mill product is then transported from the caster to a pre-heat furnace at a finishing mill for subsequent rolling.

Conventional technology usually is to pick up the semi-finished mill product from above and place it on an open flatbed vehicle or other, which transports the product to the hot mill or other location. Most mill products are often transported in the same conventional way.

SUMMARY

One aspect of the present disclosure includes a thermal box assembly for insulating a mill product. Thermal box assembly includes a platform, an insulated enclosure and an actuator system. The platform is capable of supporting the mill product and has a first long side and a second long side. The insulated enclosure includes a first door and a second door each having an open position and a closed position. The first door is hingedly connected to the first long side of the platform by a first connector such that the first door is pivotable by at least 90 degrees about the first connector. The second door is hingedly connected to the second long side of the platform by a second connector, such that the second door is pivotable by at least 90 degrees about the second connector. When each of the first and the second doors is pivoted by at least 90 degrees, the insulated enclosure is in an open position that enables access to the platform from above. When the first door and the second door are pivoted 0 degrees, the insulated enclosure is in a closed position, whereby the platform is enclosed. The actuator system may move the first door and the second door between their open and closed positions.

Another aspect of the present disclosure includes a transport system for transporting a mill product. The system includes a flatbed, a platform, an insulated enclosure, and an actuation system. The flatbed is capable of being transported. The platform is supported by the flatbed and capable of supporting the mill product. The insulated enclosure includes a first door and a second door each having an open position and a closed position. The first door is hingedly connected to the first long side of the platform by a first connector such that the first door is pivotable by at least 90 degrees about the first connector. The second door is hingedly connected to the second long side of the platform by a second connector, such that the second door is pivotable by at least 90 degrees about the second connector. When each of the first and the second doors is pivoted by at least 90 degrees, the insulated enclosure is in an open position that enables access to the platform from above. When the first door and the second door are pivoted 0 degrees, the insulated enclosure is in a closed position, whereby the platform is enclosed. The actuator system may move the first door and the second door between their open and closed positions.

Another aspect of the present disclosure includes an insulated clamshell thermal box enclosure. Thermal box enclosure includes a platform, an insulated clamshell enclosure, an actuator system, and a redundant manual system. The platform has opposing longitudinal sides. The insulated clamshell enclosure includes a left and a right clamshell each having an open position and a closed position. In their closed positions, the clamshells are capable of fully enclosing the platform. The left clamshell has a hinged connection to a left longitudinal side of the platform. The right clamshell has a hinged connection to a right longitudinal side of the platform. Each clamshell is pivotable by at least 90 degrees to an open position that enables access to the platform from above. The actuator system is configured to move the clamshells between their open and closed positions. The redundant manual system is also configured to move the clamshells between their open and closed positions.

DETAILED DESCRIPTION OF ILLUSTRATIVE EMBODIMENTS

The disclosure relates generally to a system and method for a thermal protective barrier to preserve temperature in semi-finished mill products. The system includes an enclosure assembly having an insulated housing with a base capable of supporting a hot metal slab or other semi-finished mill product. The metal slab may be placed on the base, whereby a pair of doors may close on top of the metal slab insulating it from the external environment. The base is supported by a vehicle, such as a flatbed of a truck, for handling and transportation from one location to another.

Figure 1:
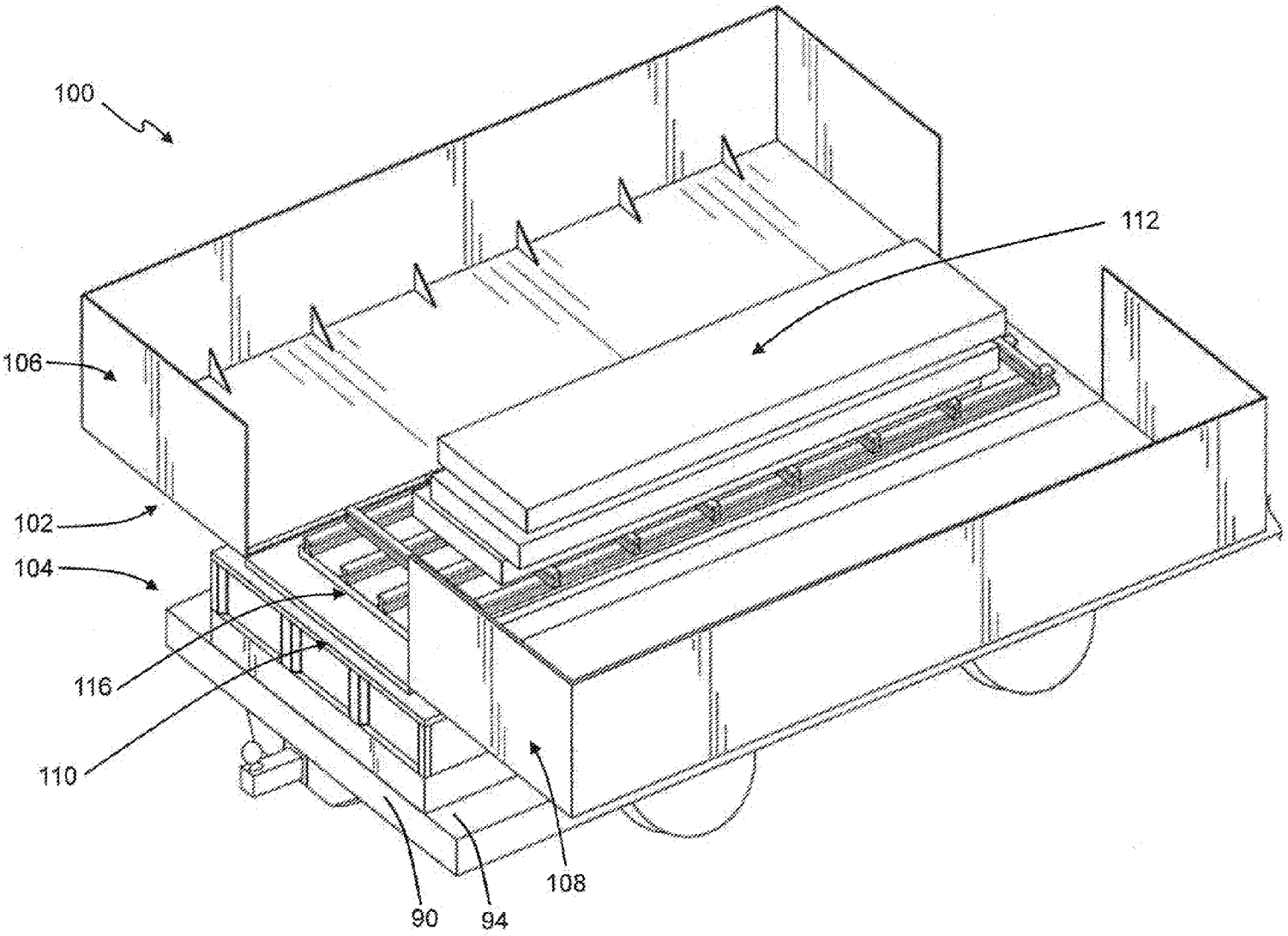
FIG. 1 is a perspective view of a thermal box assembly positioned on a vehicle with thermal doors in an open position, according to an aspect of this disclosure.

FIG. 1 illustrates a thermal box enclosure 100 positioned on a flatbed 90 of a transportation vehicle, such as a flatbed truck. Flatbed 90 preferably includes a conventional load supporting deck 94 that is substantially flat and parallel with the ground S.

Thermal box enclosure 100 includes an enclosure body 102, a base 104, and a connection 114 between enclosure body 102 and base 104. Enclosure body 102 includes a first door and a second door, each of which is hinged on the long sides of base 104. Preferably, the first and second doors are left and right clamshell structures. The left clamshell 106 is the mirror image of the right clamshell 108 in the figures, except for an optional flange or like structure to seal the edges, which will be understood by persons familiar with enclosure technology. Structural supports or gussets, such as structural angles or channels (as shown in the figures) may be employed to stiffen the structure.

The clamshell enclosures 106 and 108 in FIG. 1 are in an open position which allows for access to a platform 110, described more fully below. A mill product 112 may be placed on top of and supported by the platform 110 or may be placed on top of and supported by the structural stack 116. The mill product 112 may be placed on the platform 110 and/or structural stack 116, and subsequently removed from the platform 110 and/or stack 116, by a forklift or crane, such as an overhead crane, free standing crane, or the like. It should be appreciated that other means may be used to place and remove the mill product 112 from the platform 110. As used herein, the terms "mill product" and "semi-finished mill product" encompass hot products and/or intermediate products.

Figure 2:
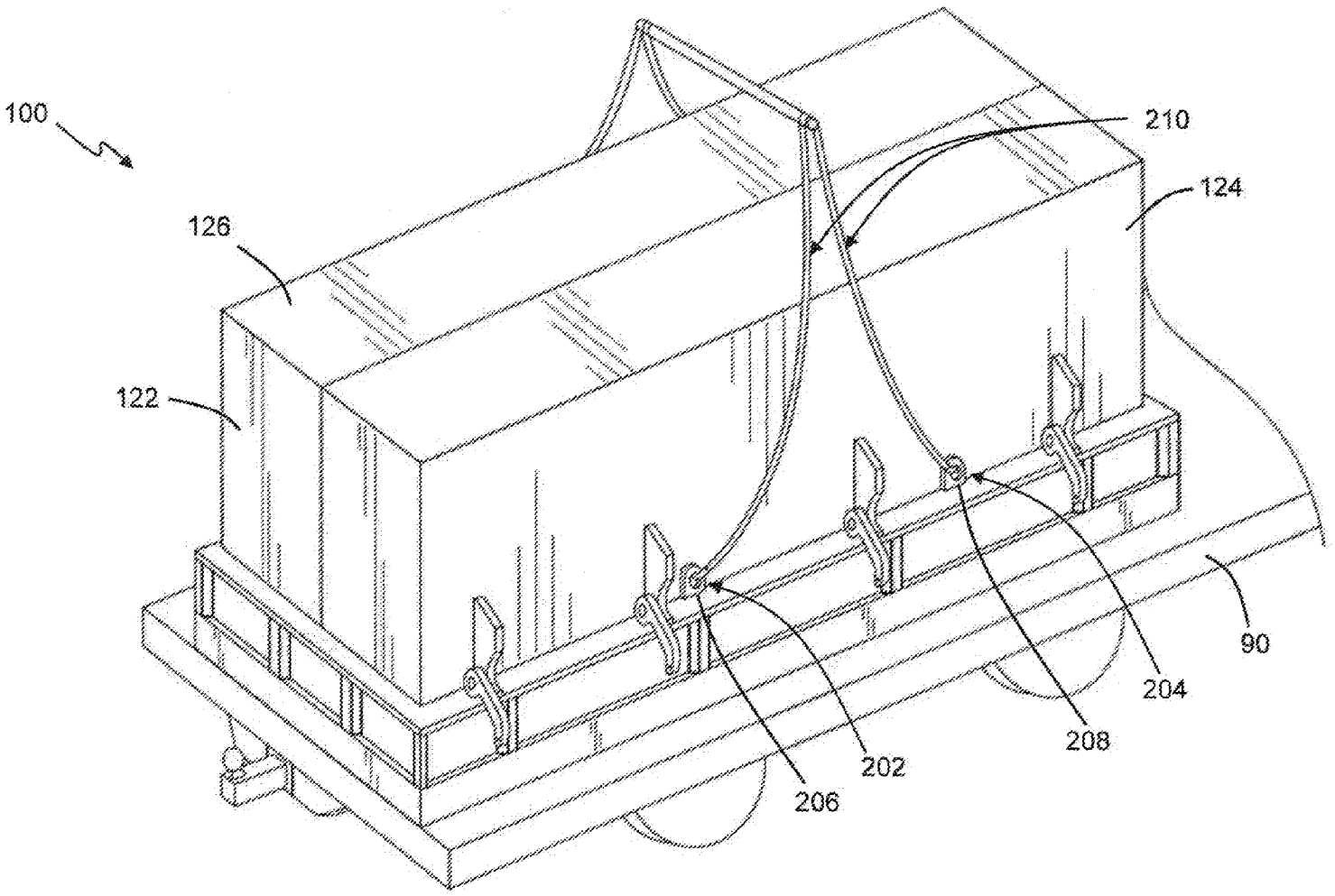
FIG. 2 is a perspective view of a thermal box assembly positioned on a vehicle with thermal doors in a closed position, according to an aspect of this disclosure.

FIG. 2 illustrates thermal box enclosure 100 positioned on the flatbed 90 with the enclosure body 102 in a closed position. In the closed position, the clamshell members 106 and 108 form an enclosure surrounding (or substantially surrounding) mill product 112 on five sides, therefore with structural stack 116 and/or flatbed 90 forming a closed box. In this regard, each clamshell 106, 108 includes a rear panel 120 (FIG. 5), an opposing front panel 122, a long side panel 124, and a top panel 126.

Base 104 of the enclosure 100 further includes a set of lifting lugs 202 and 204 with opposing lifting lugs on the opposite side of thermal box enclosure 100. The lifting lugs 202 and 204 may be attached to the platform 110 at connection points 206 and 208, respectively. The sets of lifting lugs may be configured to support the entire thermal box enclosure 100 such that the enclosure 100 may be lifted from the ground S or the flatbed 90. The enclosure 100 may be lifted, for example, by cables 210 attached to the lifting lugs 202 and 204. It should be appreciated that the thermal box enclosure 100 may include a plurality of lifting lugs 202 and 204 and/or a plurality of cables 210 capable of lifting the enclosure 100.

Figure 3:
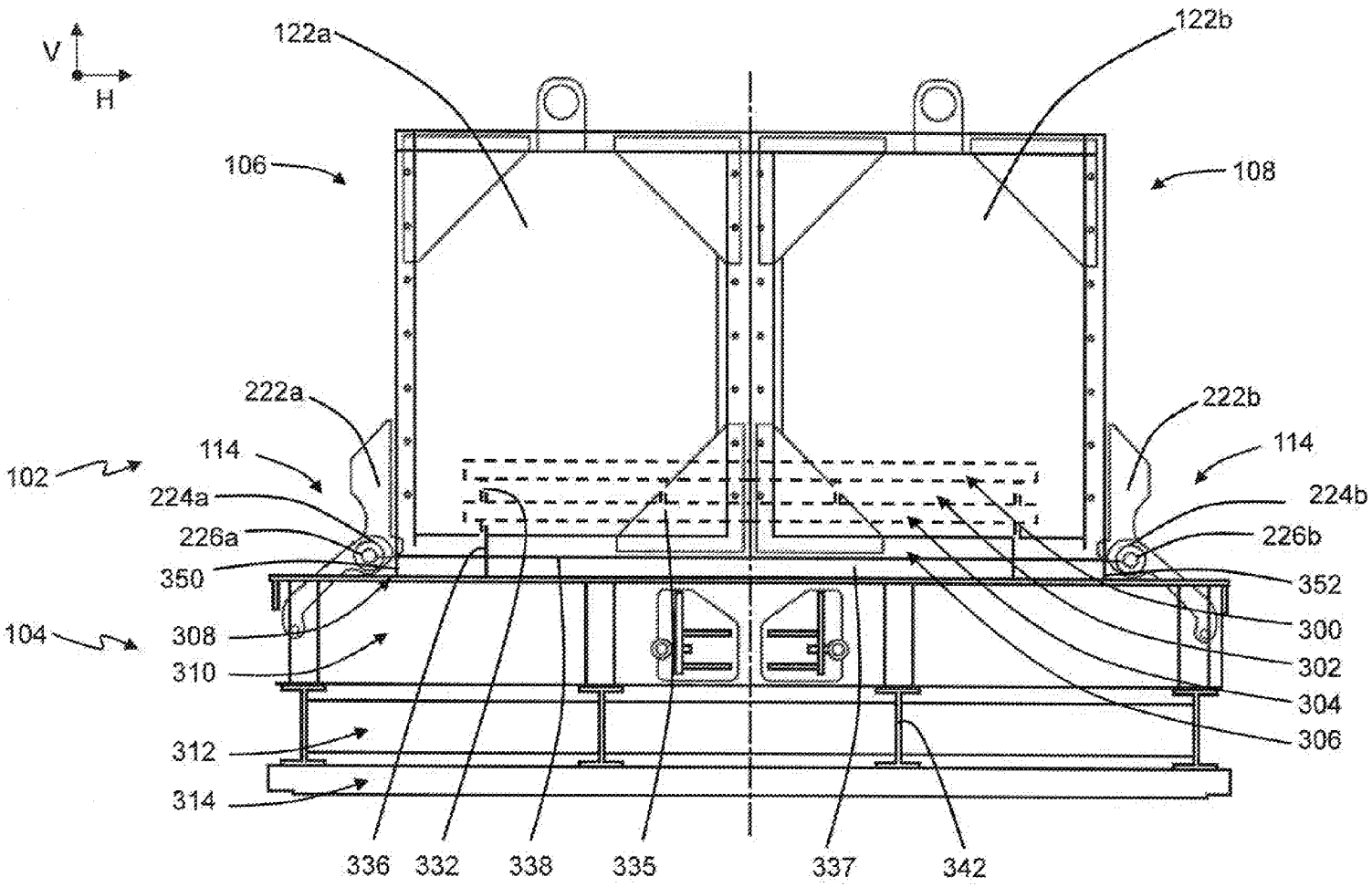
FIG. 3 is a front view of a thermal box assembly with thermal doors in a closed position, according to an aspect of this disclosure.
Figure 4:
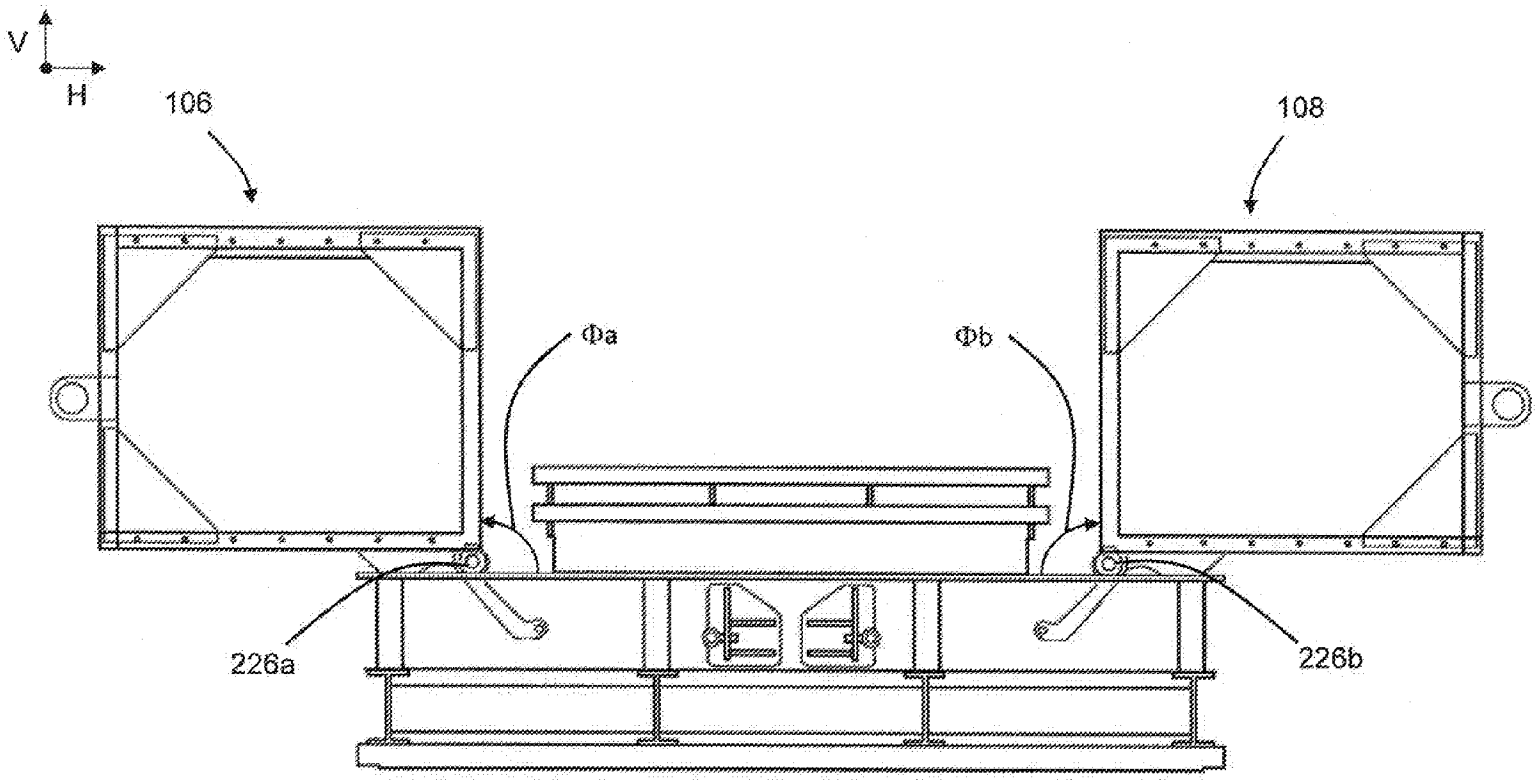
FIG. 4 is a front view of a thermal box assembly with thermal doors in an open position, according to an aspect of this disclosure.

FIG. 3 illustrates a front view of thermal box enclosure 100 with the clamshell enclosure members 106 and 108 in a closed position. FIG. 4 illustrates a front view of thermal box enclosure 100 with the clamshell enclosures 106 and 108 in an open position. Each clamshell enclosure 106 and 108 may rotate Φa and Φb degrees about hinges 226*a* and 226*b*, respectively. Angles Φa and Φb preferably are at least 90 degrees relative to the platform 110, allowing for access to the structured stack 116 within. In alternate embodiments, the clamshell members 106 and 108 may have configurations such that the rotation angles Φa and Φb may be less than 90 degrees while still providing adequate access to the structural stack 116.

Figure 5:
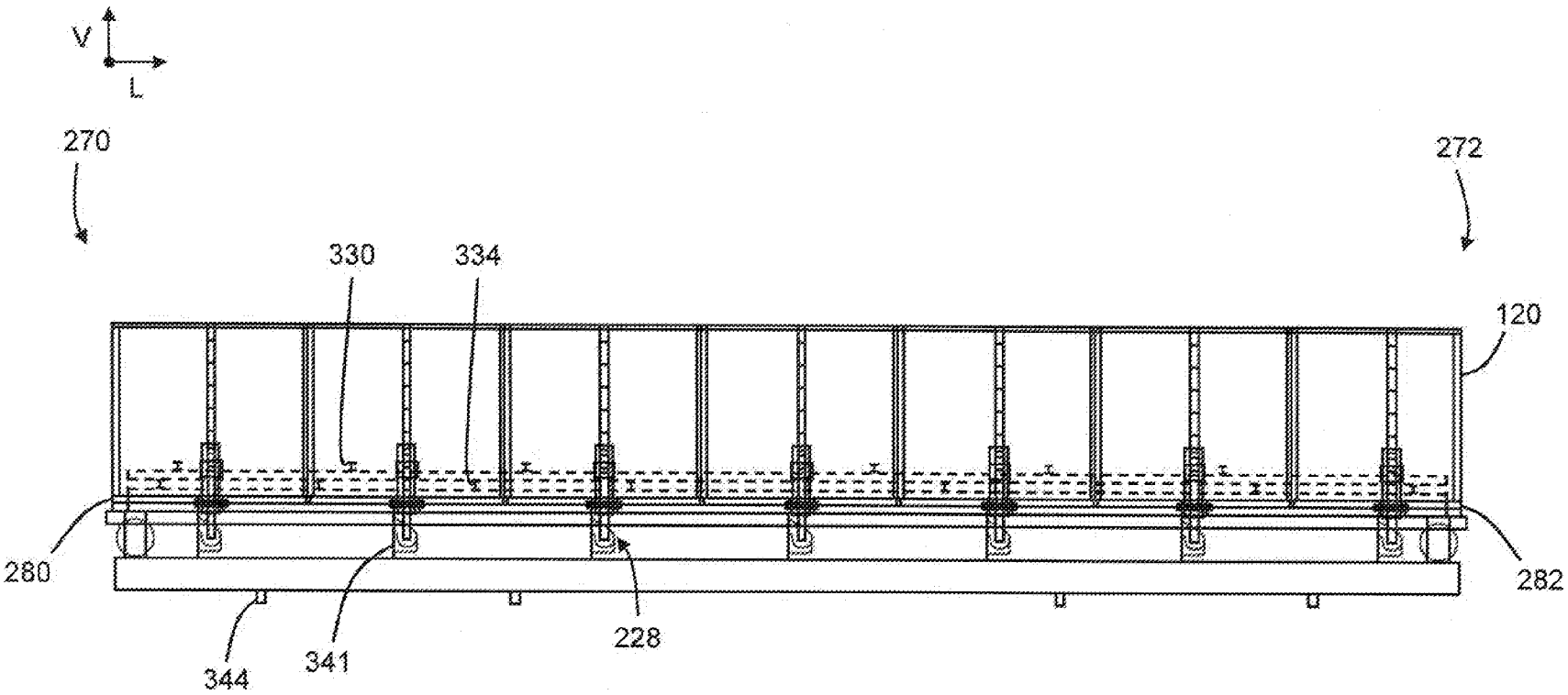
FIG. 5 is a side view of a thermal box assembly with thermal doors in a closed position, according to an aspect of this disclosure.

The first and second clamshell enclosure members 106 and 108 may open and closed by rotating about the attachment assembly 114. The attachment assembly 114 may include a plurality of hinge lugs 222*a* and 222*b* and hinge members 224*a* and 224*b* spaced along the longitudinal direction L (FIG. 5). Each of the hinge lugs 222*a* and 222*b* may include an upper arm portion and a lower arm portion. The upper arm portion of each hinge lug 222*a* and 222*b* may be affixed to each clamshell enclosure member 106 and 108, respectively. Each set of lugs 222*a* and 222*b* and hinge members 224*a* and 224*b* may function as described above.

Additionally, each set of lugs 222*a* and 222*b* and hinge members 224*a* and 224*b* may include an actuating cylinder 228 (FIG. 5). The actuating cylinder 228 may be configured to actuate clamshells 106, 108 to move them between an open and closed configuration about hinges 226*a* and 226*b*. In this regard, the cylinders 228 are attached between base 104 or other fixed structure and an arm of lugs 222*a*, 222*b* such that extension of the cylinder 228 moves the lugs 222*a*, 222*b* and corresponding clamshell 106, 108 to, for example, the closed position. Retraction of the cylinder 228 pivots the clamshell 106, 108 and lugs 222*a*, 222*b* in the opposition direction to or toward, for example, the open position. Preferably, the cylinder 228 may be attached to the lower arm of the hinge lugs 222*a*, 222*b*. The actuating cylinders 228 may include pneumatic cylinders, hydraulic cylinders, or other actuation mechanism configured to provide a force to rotate the doors about the hinges. The thermal box enclosure 100 can include controls to enable an operator to control the cylinders 228.

The first and second clamshell enclosure members 106 and 108 may also be rotated to and from the open and closed positions manually. In the embodiment that does not include the actuators, the enclosure members 106 and 108 can be moved by any means, such as a crane, come-along, forklift, and the like.

Returning to FIG. 3, base 104 is positioned at least partially below the upper portion 102 in a vertical direction V. The structural stack 116 is positioned above the platform 110, such that the platform 110 may be capable of supporting the structural stack 116 and the first and second enclosure members 106 and 108. The terms "above" and "below," as used herein, describe the positions of certain components relative to one another and are thus approximations. The terms "above", "upper", or "uppermost" mean a position that is closer to the enclosure body 102 in the vertical direction V, and the terms "below", "bottom", or "bottom-most" mean a position closer to base 104 in the vertical direction V.

The structural stack 116 may include multiple layers of structural steel and/or plate positioned one on top of the other, such as multiple beams, channels, and the like positioned side by side in a horizontal direction H, a longitudinal direction L, or at varying angles extending in the horizontal direction H and longitudinal direction L. As used herein, the term "support member" includes any structure capable of supporting mill product 112, regardless of its cross sectional shape. As described herein, the horizontal direction H may be perpendicular to the vertical direction V and extend along a direction from a center of a first front panel 122*a* of the left clamshell 106 to a center of a second front panel 122*b* of the right clamshell 108. The longitudinal direction L may be perpendicular to the vertical direction V and perpendicular to the horizontal direction H, and extend from the front end 270 to the back end 272 of thermal box enclosure 100, as shown in FIG. 5.

Referring to FIGS. 3, 4, and 5, first layer 300 of the structural stack 116 may include multiple support members or beams 330 extending in the horizontal direction H. Each beam 330 may be spaced from each other beam within first layer 300 in the longitudinal direction L. In an embodiment, each beam 330 may be evenly spaced from each other beam 330 in the longitudinal direction L. Alternatively, beams 330 may be spaced according to the composition or dimensions of the mill product 112, such that more or less support may be provided at certain points along the first layer 300.

The first layer 300 may be attached to a second layer 302 positioned below the first layer 300 in the vertical direction V. Each layer 300 and 302 may be attached by welding, adhesives, clamps, bolts, or other means commonly used to attach support members. It should be appreciated that each layer described herein may be attached in a similar manner as the described attachment between the first layer 300 and the second layer 302.

The second layer 302 may include multiple support members or beams 332 extending in the longitudinal direction L. Each beam 332 may be spaced from each other beam within the second layer 302 in the horizontal direction H. Each beam 332 may be evenly spaced from each other beam 332 in the horizontal direction H, or each beam 332 may be spaced according to the composition or dimensions of the mill product 112, such that more or less support may be provided at certain points along the second layer 302.

The second layer 302 may be attached to a third layer 304 positioned below the second layer 302 in the vertical direction V. The third layer 304 may include multiple support members or beams 334 extending in the horizontal direction H. Each beam 334 may be spaced from each other beam within the third layer 304 in the longitudinal direction L. Each beam 334 may be evenly spaced from each other beam 334 in the longitudinal direction L, or each beam 334 may be spaced according to the composition of the mill product 112, such that more or less support may be provided at certain points along the third layer 304.

The third layer 304 may also include a first thermal insulator 335. The first thermal insulator 335 may be positioned between each beam 334 within the third layer and may extend from the front end 270 to the back end 272 of thermal box enclosure 100, and may extend from a bottommost portion of the third layer 304 to an uppermost portion of the third layer 304. The first thermal insulator 335 may be capable of reducing the heat transfer from the mill product 112 to the external environment. The first thermal insulator 335 may be made of any material commonly used in the art for insulation including fiberglass, rock wool, polystyrene foam, urethane foam, perlite, cork, or the like. Further, unless described otherwise, each insulation material described herein may include material similar to the thermal insulator 335.

The third layer 304 may be attached to a fourth layer 306 positioned below the third layer 304 in the vertical direction V. The fourth layer 306 may include multiple support members or beams 336 extending in the longitudinal direction L. Each beam 336 may be spaced from each other beam within the fourth layer 306 in the horizontal direction H. Each beam 336 may be evenly spaced from each other beam 336 in the horizontal direction H, or each beam 336 may be spaced according to the composition of the mill product 112, such that more or less support may be provided at certain points along the fourth layer 306.

The fourth layer 306 may also include a second thermal insulator 337. The second thermal insulator 337 may be positioned between each beam 336 within the fourth layer 306 and may extend from a bottommost portion of the fourth layer 306 to an uppermost portion of the fourth layer 306. Alternatively, the second thermal insulator 337 may extend from the bottom most portion of the fourth layer 306 to an insulation level 338 that is below the uppermost portion of the fourth layer 306, covering only a portion of the fourth layer 306. The second thermal insulator 337 may extend beyond each beam 336 in the longitudinal direction L. The thermal insulator 337 may extend to a position 280 at the front end 270 of thermal box 100 and to a position 282 at the back end 272 of thermal box 100. Additionally, the thermal insulator 337 may extend in the horizontal direction H to positions 350 and 352, which may extend beyond the distances of each of the upper layers 300, 302, and 304 in the horizontal direction H.

The second thermal insulator 337 may be capable of supporting each clamshell enclosure member 106 and 108. In an embodiment, each enclosure member 106 and 108 may be positioned above the second thermal insulator 337 in the vertical direction V and/or in direct contact with the second thermal insulator 337.

It should be appreciated, that in alternate embodiments the structural stack 116 may include more or fewer layers 300, 302, 304, and 306. Further, the beams composing each layer 300, 302, 304, and 306 may not be substantially perpendicular to each layer positioned above and below, whereby each layer may be angularly offset from each other layer by angles ranging from 0 to 90 degrees.

The fourth layer 306 may be attached to a first platform layer 308 positioned below the fourth layer 306 in the vertical direction V. The first platform layer 308 may compose the uppermost portion of the platform 110. The first platform layer 308 may include a metal sheet capable of supporting the structural stack 116 and the clamshell enclosure members 106 and 108. The first platform layer 308 may extend in the longitudinal direction L from the front end 270 to the back end 272 of thermal box enclosure 100 and in the horizontal direction H. In an embodiment, the first platform layer 308 may extend in the horizontal direction H to at least the positions 350 and 352 of the second thermal insulator 337.

The first platform layer 308 may be attached to a second platform layer 310 positioned below the first platform layer 308 in the vertical direction V. The second platform layer 310 may include multiple support members or beams 341 extending in the horizontal direction H. Each beam 341 may be spaced from each other beam within the second platform layer 310 in the longitudinal direction L. Each beam 341 may be evenly spaced from each other beam 341 in the longitudinal direction L, or each beam 341 may be spaced according to the dimensions of the structural stack 116, such that more or less support may be provided at certain points along the second platform layer 310.

The second platform layer 310 may be attached to a third platform layer 312 positioned below the second platform layer 310 in the vertical direction V. The base layer 314 may include multiple support members or beams 344 extending in the horizontal direction H. Each beam 344 may be spaced from each other beam within the base layer 314 in the longitudinal direction L. Each beam 344 may be evenly spaced from each other beam 344 in the longitudinal direction L, or each beam 344 may be spaced according to the dimensions of the structural stack 116, such that more or less support may be provided at certain points along the base layer 314.

The third platform layer 312 may be attached to a base layer 314 positioned below the third platform layer 312 in the vertical direction V. The third platform layer 312 may include multiple support members or beams 342 extending in the longitudinal direction L. Each beam 342 may be spaced from each other beam within the third platform layer 312 in the horizontal direction H. Each beam 342 may be evenly spaced from each other beam 342 in the horizontal direction H, or each beam 342 may be spaced according to the dimensions of the structural stack 116, such that more or less support may be provided at certain points along the third platform layer 312.

It should be appreciated, that in alternate embodiments the platform may include more or fewer layers, such as those identified as layers 308, 310, 312, and 314. Further, the supports of each layer 308, 310, 312, and 314 may not be substantially perpendicular to each of the beams in each layer positioned above and below, whereby each layer may be angularly offset from each other layer by angles ranging from 0 to 90 degrees.

It should be appreciated that each of the platform layers 308, 310, 312, and 314 compose a portion of the platform 110. Further, each layer 300, 302, 304, and 306 of the structural stack 116 and each layer 308, 310, 312, and 314 of the platform 110 may be manufactured using a variety of metals including steel, iron, aluminum, brass, nickel, titanium, or the like, or manufactured using other materials including brick, clay, cement, wood, or other material capable of supporting a load or mill product 112. Further, other enclosure structures are contemplated, such as clamshells that are not mirror images, such that access to the mill product 112 within may be accomplished by rotating one clamshell about a hinge.

The structure disclosed herein is capable of handling a mill product 112 having a temperature in excess of 700 degrees Celsius. Enclosure 100 can diminish the temperature drop of the mill product 112 within the thermal box enclosure 100. In this regard, the temperature loss of the mill product 112 within thermal box enclosure 100 when each of the enclosure members 106 and 108 is in the closed position may be less than about 20 degrees Celsius per hour when the mill product 112 is at an elevated temperature.

While the disclosure is described herein using a limited number of embodiments, these specific embodiments are not intended to limit the scope of the disclosure as otherwise described and claimed herein. Modification and variations from the described embodiments exist. More specifically, the following examples are given as a specific illustration of embodiments of the claimed disclosure. It should be understood that the invention is not limited to the specific details set forth in the examples.

What is claimed:

1. A thermal box enclosure for insulating a mill product, comprising:

a platform capable of supporting the mill product, the platform having a first long side and a second long side, and the platform extending in a longitudinal direction and a vertical direction, the platform comprising:

a first plurality of support members, and a second plurality of support members positioned below the first plurality of support members in the vertical direction, the second plurality of support members connected to the first plurality of support members and angularly offset from the first plurality of support members in the longitudinal direction;

an insulated enclosure comprising:

a first door having an open position and a closed position, wherein the first door is hingedly connected to the first long side of the platform by a first connector such that the first door is pivotable about the first connector, a second door having an open position and a closed position, wherein the second door is hingedly connected to the second long side of the platform by a second connector such that the second door is pivotable about the second connector, wherein the insulated enclosure in the open position enables access to the platform from above to remove the mill product vertically from the platform, and wherein when the first door and the second door are in the closed position the insulated enclosure is in the closed position and the platform is enclosed; and an actuator system for moving the first door and the second door between their open and closed positions.

2. The thermal box enclosure of claim 1, wherein the insulated enclosure is an insulated clamshell enclosure, wherein the first door is a first clamshell member and the second door is a second clamshell member.

3. The thermal box enclosure of claim 1, wherein when the insulated enclosure is in the closed position the platform is fully enclosed.

4. The thermal box enclosure of claim 1, wherein the platform is capable of being attached to a flatbed of a vehicle.

5. The thermal box enclosure of claim 1, wherein the actuator system is a manual system for moving the first door and the second door between their open and closed positions.

6. The thermal box enclosure of claim 1, wherein the first plurality of support members extend along the longitudinal direction of the platform.

7. The thermal box enclosure of claim 1, wherein the second plurality of support members is perpendicular to the first plurality of support members.

8. The thermal box enclosure of claim 1, wherein the platform further includes a third member positioned below the second plurality of support members in the vertical direction, the third member having a first surface and a second surface, wherein the first surface is in contact with the second plurality of support members, and wherein the third member is configured to provide thermal insulation between the first surface and the second surface.

9. The thermal box enclosure of claim 1, wherein the first door is hingedly connected to the first long side of the platform by multiple connectors, and wherein the second door is hingedly connected to the second long side of the platform by multiple connectors.

10. The thermal box enclosure of claim 1, wherein the mill product is a hot slab of metal.

11. The thermal box enclosure of claim 1, wherein the actuator system includes multiple pneumatic cylinders.

12. The thermal box enclosure of claim 1, wherein when the insulated enclosure is in the open position, the first door is pivoted about the first connector by at least 90 degrees and the second door is pivoted about the second connector by at least 90 degrees.

13. A transport system for transporting a mill product, comprising:

a flatbed capable of being transported;

a platform supported by the flatbed, the platform being capable of supporting the mill product;

an insulated clamshell enclosure comprising:

a first door having an open position and a closed position, wherein the first door is hingedly connected to the first long side of the platform by a first connector such that the first door is pivotable about the first connector, a second door having an open position and a closed position, wherein the second door is hingedly connected to the second long side of the platform by a second connector such that the second door is about the second connector, wherein the insulated enclosure in the open position enables access to the platform from above to remove the mill product vertically from the platform, and wherein when the first door and the second door are in the closed position the insulated enclosure is in the closed position and the platform is enclosed;

an actuator system for moving the first door and the second door between their open and closed positions; and lugs spaced along the flatbed, wherein the flatbed includes a first long side and a second long side, wherein the lugs are positioned along each of the long sides.

14. The transport system of claim 13, further comprising a redundant manual system for moving the first door and the second door between their open and closed positions.

15. The transport system of claim 13, further comprising a vehicle, wherein the flatbead is connected to the vehicle.

16. The transport system of claim 13, wherein each one of the lugs further includes an upper arm, a pivot, and a lower arm, wherein each upper arm is affixed to one of the doors, and wherein each lower arm is attached to a cylinder of the actuator system and is opposite each upper arm, such that the lugs enable each door to pivot relative to the flatbed to form a hinge of the insulated clamshell enclosure.

* * * * *